United States Patent [19]

Spamer

[11] Patent Number: 5,016,759

[45] Date of Patent: May 21, 1991

[54] ARTICLE DISPLAY DEVICE

[75] Inventor: William S. Spamer, Roswell, Ga.

[73] Assignee: The Mead Corporation, Dayton, Ohio

[21] Appl. No.: 569,076

[22] Filed: Aug. 17, 1990

[51] Int. Cl.[5] ..... A47F 7/00

[52] U.S. Cl. ..... 211/13; 248/902

[58] Field of Search ..... 211/13, 163, 133, 59.2, 211/128, 194, 71; 248/902

[56] References Cited

U.S. PATENT DOCUMENTS

| | | | |
|---|---|---|---|
| 4,030,608 | 6/1977 | Howard | 211/163 X |
| 4,541,534 | 9/1985 | Strauss | 211/133 X |
| 4,586,619 | 5/1986 | Eckert | 248/902 X |
| 4,609,975 | 9/1986 | Badolato et al. | 248/902 X |

FOREIGN PATENT DOCUMENTS

| | | | |
|---|---|---|---|
| 2342570 | 4/1974 | Fed. Rep. of Germany | 248/902 |
| 2403048 | 5/1979 | France | 248/902 |

*Primary Examiner*—Alvin C. Chin-Shue
*Assistant Examiner*—Sarah A. Lechok
*Attorney, Agent, or Firm*—Rodgers & Rodgers

[57] ABSTRACT

For displaying articles such as eyeglasses at a point of purchase, a plurality of cavities each including bottom, top and inwardly tapered side walls are arranged in interconnected side by side relation to form a tier, the tiers being interconnected to form a display tower having a domed cover and a flat base portion interconnected with the bottom of the tower by a bearing structure whereby the tower is rendered rotatable about a vertical axis. Each cavity includes a support beam mounted on its bottom panel and having an upper ridge portion in which a recess is formed for removably receiving a part of a displayed article such as the nose portion of a pair of eyeglasses.

12 Claims, 3 Drawing Sheets

ARTICLE DISPLAY DEVICE

TECHNICAL FIELD

This invention relates to article display devices primarily for use at points of purchase for displaying a wide variety of relatively small items.

BACKGROUND ART

Devices for displaying articles such as eyeglasses which are currently used frequently include a panel in which apertures are formed for receiving the earpieces of eyeglasses or parts of other items to be displayed. Such current display devices ordinarily do not provide a means for replenishing an article once it is removed from the display when purchased by a customer. Also if an item is removed it is difficult to replace.

SUMMARY OF THE INVENTION

According to this invention in one form, a plurality of article holders each including top, bottom and side panels are interconnected to form a tier of display cavities and the cavities are interconnected to form a tower suitable for mounting on the counter or floor of a retail outlet. For holding displayed items, a support beam is mounted on the bottom panel of each cavity and includes an upper ridge portion in which a recess is formed for removably receiving a part of a displayed item. If desired, a gravity feed feature may be incorporated whereby removal of a displayed item initiates sliding feeding movement of a second article toward the access open end of each cavity. Also lighting means may be provided which directs light toward each article display cavity to facilitate an easy visual identification and appraisal of the displayed articles.

BEST MODE OF CARRYING OUT THE INVENTION

Figure 1:
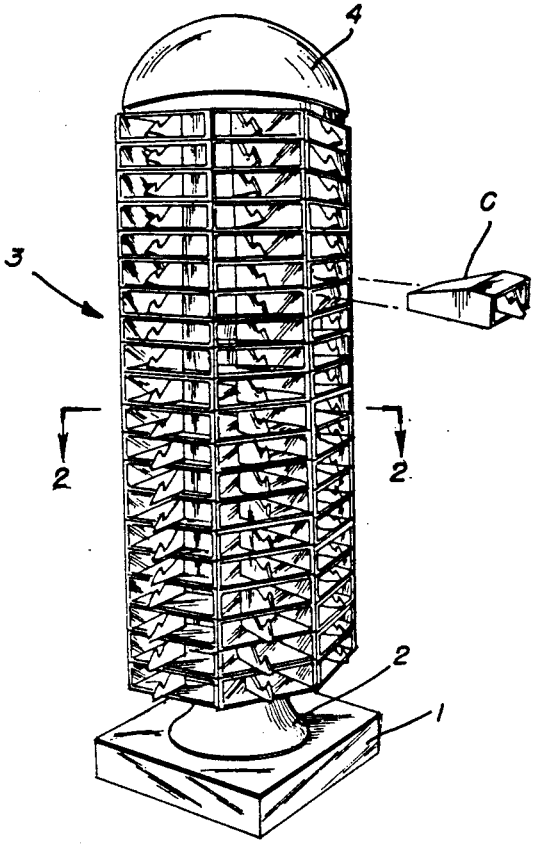
FIG. 1 is a perspective view of a display tower formed according to this invention.

In FIG. 1, a display tower formed according to this invention includes a flat base portion 1 atop which a bearing 2 is mounted for supporting a stack of cavities generally designated by the numeral 3 and atop which an arched circular dome cover 4 is mounted.

Figure 2:
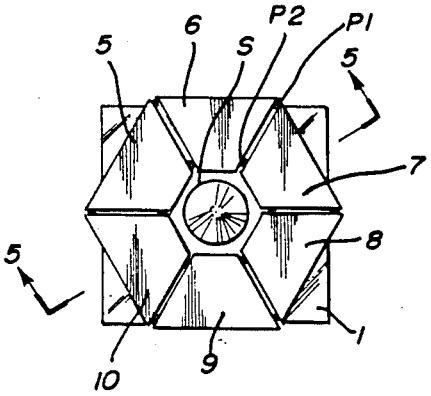
FIG. 2 is a cross sectional view taken along the line designated 2—2 in FIG. 1.

As indicated in FIG. 2, each tier represented in FIG. 1 includes a plurality of display cavities 5–10 inclusive. A single cavity designated at C indicates the positioning of a cavity such as one of the cavities designated 5–10 in FIG. 2 to form a part of the stack 3 shown in FIG. 1. As is apparent from FIG. 2, a central open space designated at S is provided.

Figure 3:
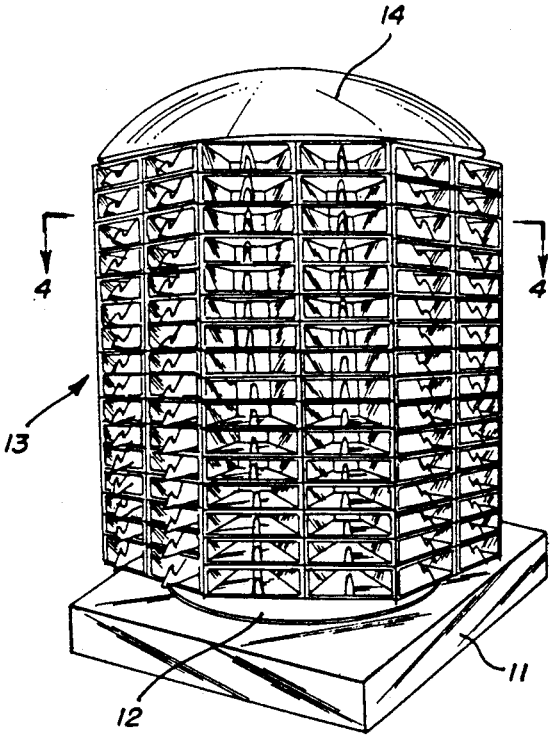
FIG. 3 is a view similar to FIG. 1 but includes a greater number of display cavities in each tier of cavities.
Figure 4:
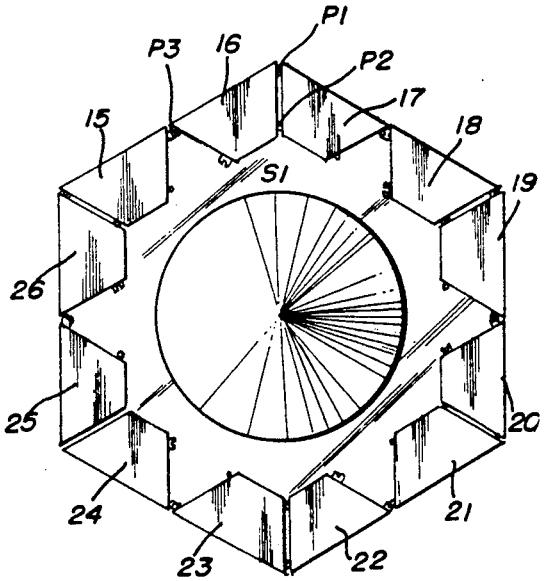
FIG. 4 is a cross sectional view taken along the line designated 4—4 in FIG. 3.

FIG. 3 is similar to FIG. 1 but accommodates a greater number of cavities as is obvious. In FIG. 3, the numeral 11 indicates a flat base and the numeral 12 designates a bearing structure for rotatably mounting the display tower 13 about a vertical axis and the numeral 14 designates an arched circular dome atop the tower 13. In FIG. 4, a plurality of cavities designated by the numerals 15–26 are shown. As is apparent in FIG. 4, adjacent cavities such as 16 and 17 are interconnected at two horizontal positions P1 and P2 as are the cavities 5–10 of FIG. 2. In FIG. 4, cavities such as 15 and 16 are connected at only one horizontal position designated in FIG. 4 at P3. An open space S1 is shown in FIG. 4.

Figure 5:
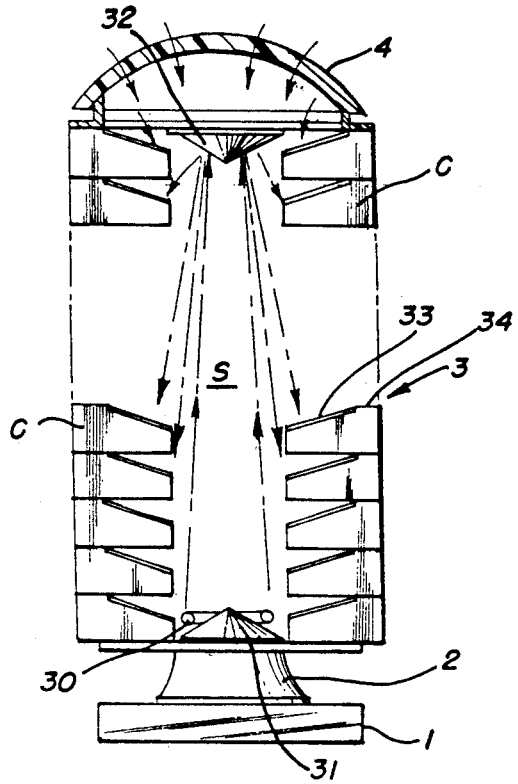
FIG. 5 is a cross sectional view taken along the line designated 5—5 in FIG. 2.
Figure 6:
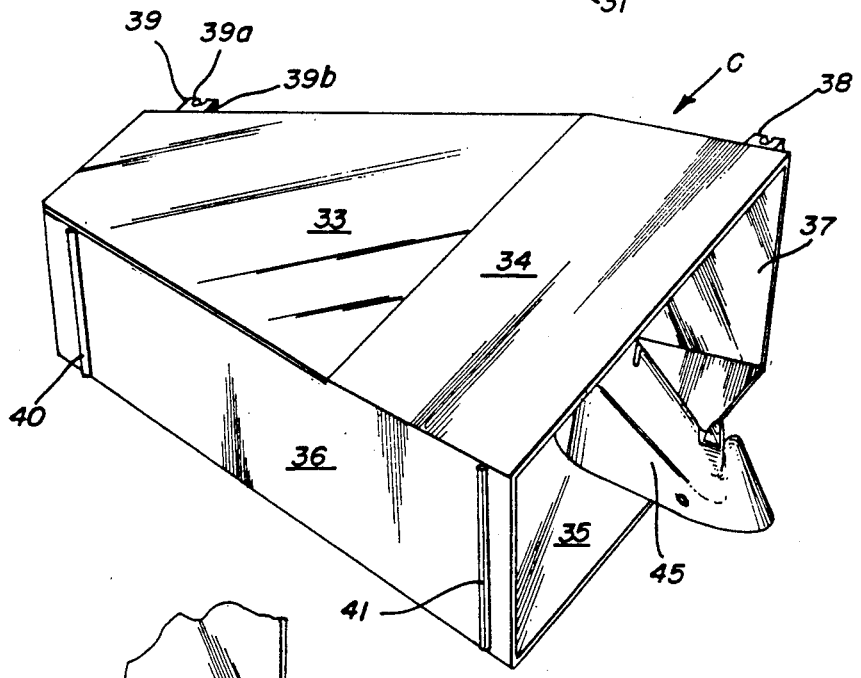
FIG. 6 is an enlarged perspective view of a display cavity formed according to one aspect of this invention.
Figure 7:
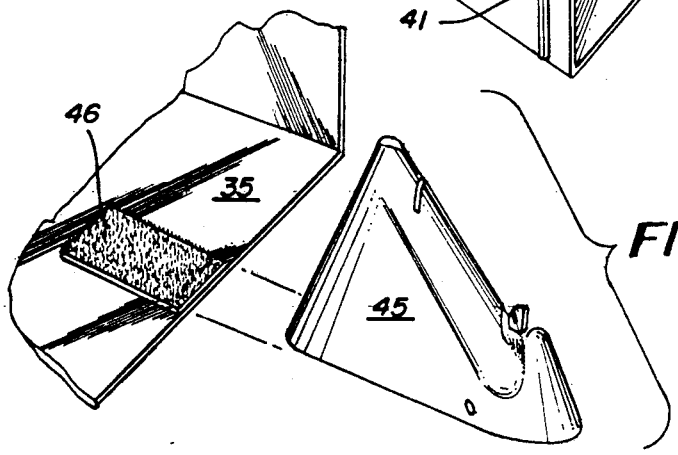
FIG. 7 is an exploded fragmentary perspective view which shows an article support beam removably mounted on the bottom panel of a display cavity such as is shown in FIG. 6.

As is apparent in FIG. 5, the space S is illuminated by means of a circular light source 30 and a pair of light reflecting cones 31 and 32. As is apparent from FIGS. 5 and 6 the top panel of each cavity C includes a downwardly inclined inner portion 33 and a horizontal outer portion 34. According to one feature of this invention, the downwardly inclined inner portion of the top panel of each cavity C is translucent and thus facilitates disbursal of light throughout the tower as is represented by the dotted lines and associated arrows in FIG. 5. Of course this feature of the invention results in a favorable and easily comprehended visual representation of the displayed articles which are mounted within each cavity.

Each cavity as is best shown in FIG.. 6 includes a bottom panel 35, side panels 36 and 37 which diverge inwardly away from the outer access end of the cavity thus enabling the cavities to be assembled as shown in FIG. 2 and in FIG. 4.

For securing each cavity to its adjacent cavity in one embodiment of the invention, a pair of gripper elements 38 and 39 are secured to one side panel such as 37. These gripper elements include a pair of spaced apart jaws such as **39*a* and 39*b***.

For insertion between the jaws **39*a* and 39*b* of one cavity, hollow tubular means which may be of any suitable cross section such as square, dovetail and the like and such as that indicated at 40 and 41 are formed on the opposite side panel of each cavity such as C. Thus in order to secure a plurality of cavities together the tubular elements such as 40 and 41 are gripped by the jaws such as 39*a* and 39*b*** of an adjacent cavity.

In order to provide interconnection vertically between the cavities of the different tiers, an elongated rod element (not shown) may be inserted into some of the hollow tubular elements 40 and 41 and thus to interconnect such aligned tubular elements so as to secure the various tiers in stacked relation one above another.

For the purpose of engaging and holding displayed items such as eyeglasses, a support beam such as indicated at 45 is permanently or removably mounted near the access end of each cavity and is secured to the bottom panel such as 35. If the support beam 45 is to be removable, it may be removably secured by means of Velcro 46 affixed to bottom panel 35 and corresponding Velcro 47 affixed to the bottom panel 45*a* of support beam 45 as best shown in FIG. 10.

Figure 10:
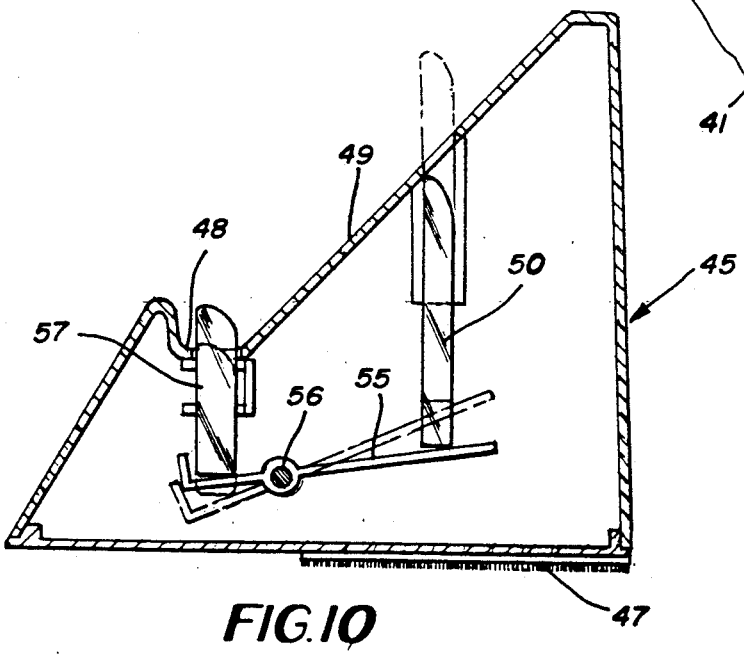
FIG. 10 is a cross sectional view of the support beam shown in FIGS. 6, 7, 8 and 9

As is best shown in FIG. 10, support beam 45 includes a recess 48 formed in the lower portion of its ridge portion 49.

Figure 8:
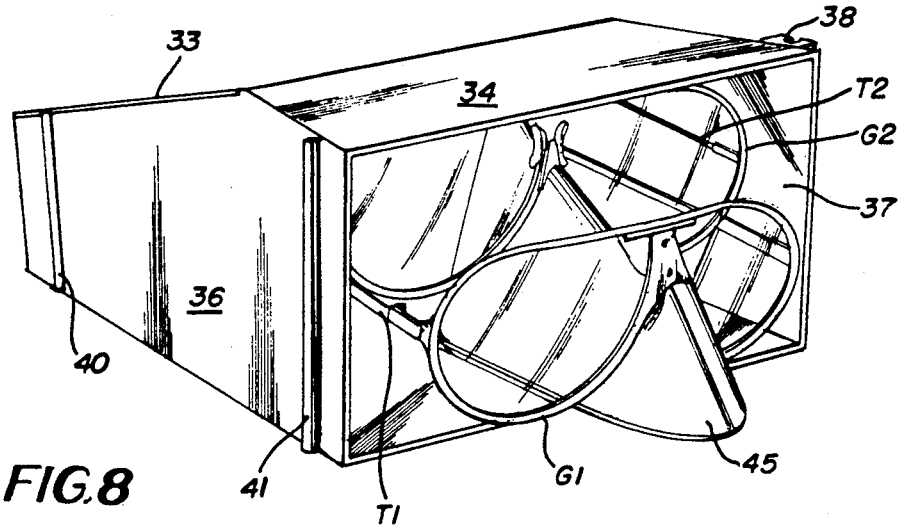
FIG. 8 is a perspective view similar to FIG. 6 but which shows a pair of eyeglasses displayed in the cavity.
Figure 9:
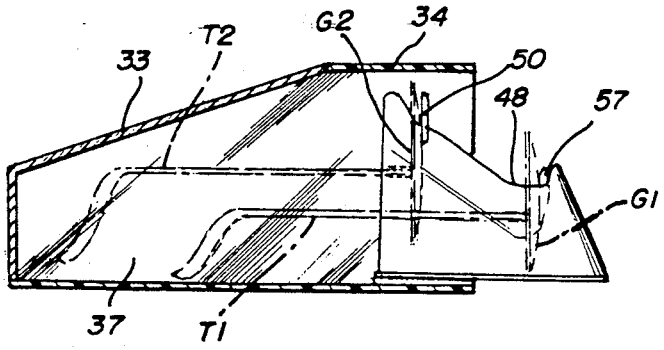
FIG. 9 is a cross sectional view of FIG. 8 and which shows two pairs of eyeglasses in phantom lines.
Figure 11:
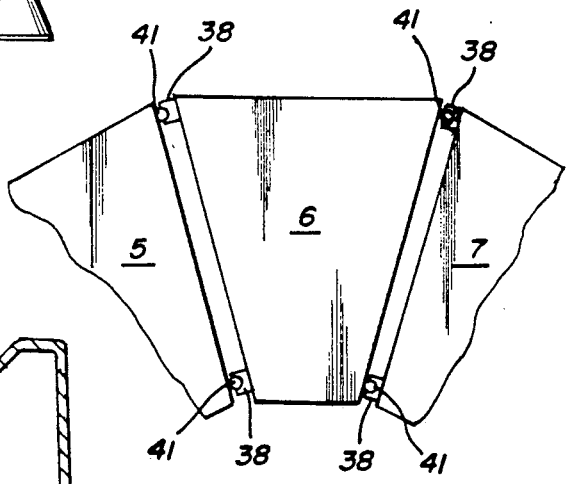
FIG. 11 is an enlarged fragmentary view which illustrates connecting means formed in the side panels of each display cavity whereby a plurality of cavities are interconnected to form a horizontal tier, the structure of FIG. 11 being adaptable for providing interconnection between tiers stacked one atop another.

With the parts shown in their dotted line positions in FIG. 10, the nose portion of one pair of eyeglasses may be secured in recess 48 as is best shown in FIG. 9 and a second pair of eyeglasses may be arranged with its nose portion disposed behind the holding means 50 as indicated schematically in FIG. 9. As shown in FIGS. 8 and 9, the temples T1 and T2 of two pairs of eyeglasses G1 and G2 are, held in position due to engagement with the side panels 36 and 37 of each cavity.

As is best shown in FIG. 10, the holding means 50 in the form of a vertically reciprocable plunger is arranged with its lower end in contact with a pivotally mounted elongated bar 55 which is pivoted at fixed pivot 56 and which engages the lower end of activating pin 57. With a pair of glasses such as G1 mounted with its nose portion in contact with activating pin 57 as best shown in FIG. 8, the activating pin 57 is held in its down position as indicated in dotted lines in FIG. 10 due to the weight of eyeglasses G1. Simultaneously the holding means in the form of vertically reciprocable rod 50 is disposed in its upper position indicated by dotted lines in FIG. 10. Eyeglasses G2 is arranged with its nose piece disposed behind the vertically reciprocable rod 50. Since the pivot point 56 for the elongated rod 55 is much closed to activating pin 57 than to the holding means in the form of vertically reciprocable rod 50 it follows that removal of eyeglasses such as G1 allows the actuating pin 57 to move to the solid line position shown in FIG. 10 and simultaneously lowers the vertically reciprocable rod 50 to its solid line position shown in FIG. 10. Following this action, eyeglasses designated G2 slide downwardly and forwardly along the inclined upper edge portion 49 of the support beam 45 to occupy the position as shown in connection with eyeglass G1 in FIG. 8 which is more readily observable and removable for purchase or otherwise according to another aspect of this invention.

I claim:

1. A holder for displaying a plurality of articles at a point of purchase, said holder comprising top, bottom and side panels interconnected to form a tubular display cavity having an open access, a support beam mounted on said bottom panel and having an upper ridge portion in which a recess is formed for removably receiving a part of a displayed article, and holding means spaced from said recess in a direction away from said access end of said display cavity and arranged to receive and hold a second displayed article.

2. A holder according to claim 1 wherein said upper ridge portion of said support beam is downwardly and forwardly inclined toward said open access end of said display cavity and wherein release means operable in coordination with removal of said displayed article from said recess is effective to operate said holding means thereby to release said second displayed article for movement into said recess via gravity feed action.

3. A holder according to claim 2 wherein said holding means comprises a vertically movable elongated plunger slidable through an aperture formed in said upper ridge portion of said support beam for engaging and releasing said article.

4. A holder according to claim 3 wherein an elongated lever is pivotally mounted intermediate its ends and arranged with one end in engagement with the lower end of said elongated plunger for imparting upward article holding movement to said plunger.

5. A holder according to claim 4 wherein a vertically movable activating pin is slidable through an aperture formed in said recess and arranged so that its upper end engages said article disposed in said recess and with its lower end in engagement with the other end of said elongated lever.

6. A holder according to claim 5 wherein said pivotal mounting of said elongated lever is disposed in substantially closer relation to said activating pin than to said vertically movable elongated plunger so that removal of said article from said recess allows said activating pin to rise and said elongated plunger to descend thereby to release said second displayed article being held by said plunger and to allow said second displayed article to move into said recess via gravity feed.

7. A holder for displaying a plurality of eye glasses at a point of purchase, said holder comprising top, bottom and inwardly converging side panels engageable with the temples of displayed eye glasses and interconnected to form a tabular display cavity having an open access end, a support beam mounted on said bottom: panel and having an upper ridge portion in which a recess is formed for removably receiving the nose portion of a pair of displayed eyeglasses.

8. A holder for displaying a plurality of articles at a point of purchase, said holder comprising a base panel and a support beam mounted on said base panel and having an upper ridge portion in which a recess is formed for removably receiving a part of a displayed article, a holding means spaced from said recess and arranged to receive and hold a second displayed article, said upper ridge portion of said support beam being downwardly inclined from said holding means toward said recess, wherein release means operable in coordination with removal of a displayed article from said recess is effective to operate said holding means thereby to release said second displayed article for movement into said recess via gravity feed action.

9. A holder for displaying a plurality of articles at a point of purchase, said holder comprising top, bottom and side panels interconnected to form a tubular display cavity having an open access end, a support beam mounted on said bottom panel and having an upper ridge portion in which a recess is formed for removably receiving a part of a displayed article, and at least portions of the inner surfaces of said top, bottom and side panels being light reflecting mirrors.

10. A holder for displaying a plurality of articles at a point of purchase, said holder comprising top, bottom and side panels interconnected to form a tubular display cavity having an open access end, and a support beam removably mounted on said bottom panel and having an upper ridge portion in which a recess is formed for removably receiving a part of a displayed article.

11. A holder for displaying a plurality of articles at a point of purchase, said holder comprising top, bottom and side panels interconnected to form a tubular display cavity having an open access end, a support beam mounted on said bottom panel and having an upper ridge portion in which a recess is formed for removably receiving a part of a displayed article, the side edges of said top and bottom panels being arranged to converge toward each other in the direction away from said access end, a plurality of said cavities being arranged in side by side relation and interconnected to form one tier of cavities, and an open space disposed at the center of said tier and a light source disposed in said open space, said light source comprising a circular light emitting tube and a first conical reflector arranged to direct light vertically and a second conical reflector toward which light is directed by said first conical reflector.

12. A holder according to claim 11 wherein a part of each of said top panels which is remote from said access end of each cavity is translucent to facilitate dispersal of light into the associated cavity.

* * * * *